US007012526B2

(12) United States Patent
Kolton et al.

(10) Patent No.: US 7,012,526 B2
(45) Date of Patent: Mar. 14, 2006

(54) ELECTRONIC ARTICLE SURVEILLANCE MARKER ASSEMBLY

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 10/117,282

(22) Filed: Apr. 6, 2002

(65) Prior Publication Data

US 2003/0189071 A1 Oct. 9, 2003

(51) Int. Cl.
*G08B 13/14* (2006.01)

(52) U.S. Cl. ..... 340/572.1; 340/571; 340/572.9

(58) Field of Classification Search ..... 340/572.1, 340/572.8, 571, 568.1, 572.6, 5.8; 29/602.1, 29/428; 40/299.01, 300, 301, 302, 625, 669; 292/367 R See application file for complete search history.

(56) References Cited

U.S. PATENT DOCUMENTS

| | | | | |
|---|---|---|---|---|
| 4,718,697 | A * | 1/1988 | Berardus van Amelsfort | 40/299.1 |
| D343,261 | S * | 1/1994 | Eberhardt | D30/155 |
| 5,574,431 | A * | 11/1996 | McKeown et al. | 340/572.1 |
| 5,777,553 | A * | 7/1998 | Perreau et al. | 340/551 |
| 5,945,909 | A | 8/1999 | Kolton | 340/572.1 |
| 5,982,282 | A * | 11/1999 | Ryan, Jr. | 340/572.1 |
| 6,098,324 | A * | 8/2000 | Nepote | 40/301 |
| 6,359,563 | B1 * | 3/2002 | Herzer | 340/572.6 |
| 6,518,886 | B1 * | 2/2003 | Elston | 340/572.8 |

* cited by examiner

*Primary Examiner*—Davetta W. Goins
(74) *Attorney, Agent, or Firm*—Hoffmann & Baron, LLP

(57) ABSTRACT

An EAS marker assembly comprises a housing defining a cavity extending inwardly from an open wall of the housing and a passage extending through a closed wall of the housing opposite the open wall and disposed aside the cavity and an EAS marker secured to the closed wall of the housing. A securement member extends through the passage and secures the EAS marker assembly to an article of manufacture, the article of manufacture closing the open wall of the housing.

16 Claims, 2 Drawing Sheets

ELECTRONIC ARTICLE SURVEILLANCE MARKER ASSEMBLY

FIELD OF THE INVENTION

This invention relates generally to security from shoplifting of articles of manufacture and pertains more particularly to electronic article surveillance marker assemblies for use with articles of manufacture.

BACKGROUND OF THE INVENTION

One form of electronic article surveillance (EAS) marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

Commonly-assigned U.S. Pat. No. 5,945,909 discloses a so-called "seal" comprising a one-piece body having first and second members closable one upon the other and thereupon respectively defining first and second outer seal walls and a tail peripherally continuous with at least one of the first and second members at a third outer seal wall the tail having a hook at a free end thereof. The seal body defines an interior recess and a detent opening into said third outer seal wall for retentive reception of the tail hook interiorly of the seal. An EAS marker is disposed in the seal body recess and is contained therein between the first and second outer seal walls upon closure of the first and second members.

The '909 patent seal is used by circumscribing a portion of an article, e.g., a watchband, with the tail and then inserting the tail hook into the seal body detent.

The EAS marker is a flat ferromagnetic strip member and is detectable by various known EAS systems, e.g., where the marker is not deactivated (as at an article payment checkout counter) and is carried through EAS marker detection gates at a facility exit.

The above first-discussed practice of applying the EAS marker to the exterior of an article of manufacture, despite its noted disadvantage, has advantage over the EAS marker hidden embodiment of the '909 patent in that the supplier of the EAS marker-equipped article of manufacture has clear awareness that the article is EAS marker-protected. Thus, the EAS marker assembly of the '909 patent is not inspectable as to the presence or absence of the EAS marker or as to its condition, i.e., intact or not intact.

SUMMARY OF THE INVENTION

The present invention has as its primary object the provision of an EAS marker assembly which overcomes the above-discussed disadvantages of known EAS marker practices.

A more particular object of the invention is to provide an EAS marker assembly which may be applied to articles of manufacture wherein deactivation of the EAS marker is not adversely affected by the composition of the article of manufacture.

In attaining the first mentioned object, the invention provides an EAS marker assembly comprising a housing defining a cavity extending inwardly from an open wall of the housing and a passage extending through a closed wall of the housing opposite the open wall and disposed aside the cavity and an EAS marker secured to the closed wall of the housing.

In another aspect, the invention provides, in combination, an article of manufacture, an EAS marker assembly comprising a housing defining a cavity extending inwardly from an open wall of the housing and a passage extending through a closed wall of the housing opposite the open wall and disposed aside the cavity and an EAS marker secured to the closed wall of the housing and a securement member extending through the passage and securing the EAS marker assembly to the article of manufacture, the article of manufacture closing the open wall of the housing.

In attaining the above-noted more particular object, the invention provides an article of manufacture, an EAS marker assembly comprising a housing defining an interior compartment and a passage extending through the housing and an EAS marker secured to a wall of the housing and a securement member extending through the passage and securing the EAS marker assembly to the article of manufacture, the housing being of a dimension such that the article of manufacture does not interfere with deactivation of the EAS marker.

The invention will be further understood from consideration of the following description of preferred embodiments thereof and from the drawings where like reference numerals identify like parts throughout.

DETAILED DESCRIPTION OF THE PREFERRED EMBODIMENT

Figure 4:
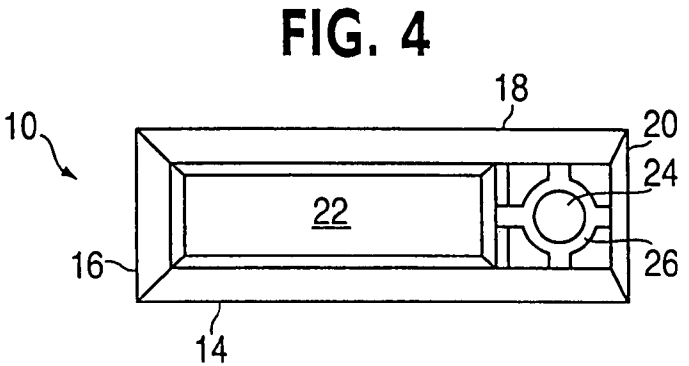
FIG. 4 is a bottom plan view of the FIG. 1 housing.
Figure 1:
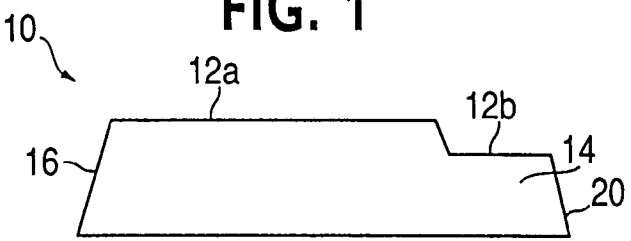
FIG. 1 is a front elevation of an EAS marker housing in accordance with the invention.
Figure 2:
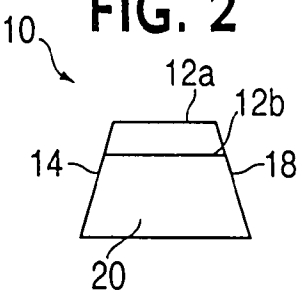
FIG. 2 is a right side elevation of the FIG. 1 housing.
Figure 5:
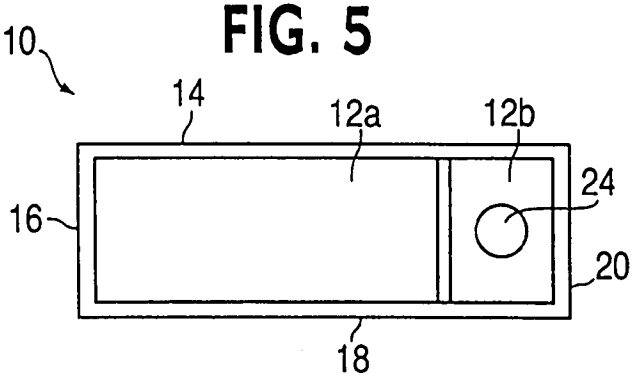
FIG. 5 is a top plan view of the FIG. 1 housing.
Figure 3:
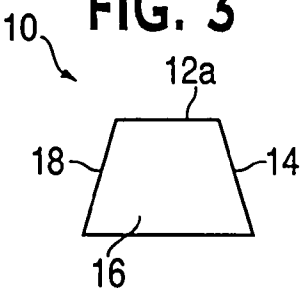
FIG. 3 is a left side elevation of the FIG. 1 housing.

Referring to FIGS. 1–5, housing 10 is a one-piece plastic body having a top wall comprised of first portion 12*a* and second portion 12*b* at respective different elevations and side walls 14, 16, 18 and 20. Housing 10 is open at its bottom wall and cavity 22 extends upwardly from such open bottom wall to top wall first portion 12*a*.

Housing 10 further defines a passage 24 opening into top wall second portion 12*b* and extending through the housing into registry with the housing open bottom. Passage 24 is bounded by interior housing structure 26 extending from the open wall to the closed wall and of cylindrical cross-section.

Figure 7:
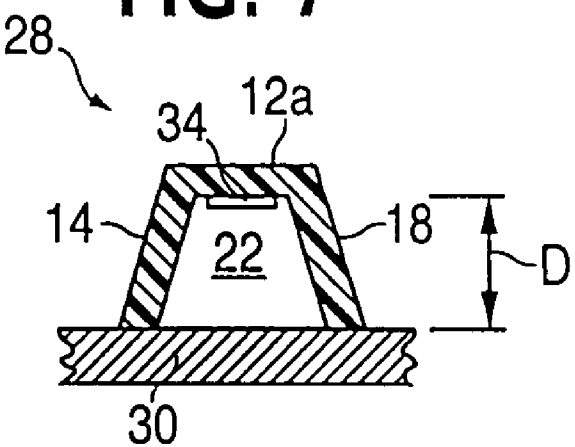
FIG. 7 is a sectional view as would be seen from plane VII—VII of FIG. 6.
Figure 6:
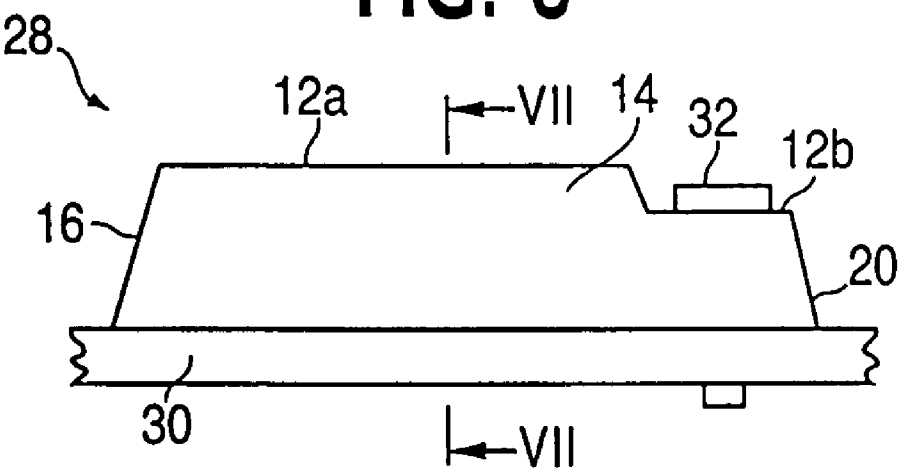
FIG. 6 is a front elevation of an EAS marker assembly secure to an article of manufacture shown in part.

Turning to FIGS. 6 and 7, EAS marker assembly 28 is shown secured to article of manufacture 30 by screw fastener 32, which extends through passage 24, abutting on top wall second portion 12*b* and being threaded into article of manufacture 30. EAS marker 34 is adhesively secured to the undersurface of top wall first portion 12*a*.

Article of manufacture 30, e.g., an automobile stereo, will be seen to close the open bottom wall of housing 10. Thus, the invention provides an EAS marker assembly, the EAS marker of which is viewable prior to assembly with an article of manufacture and is hidden from view upon completion of the assembly.

In the above-noted example of an article of manufacture, the housing thereof is a metal and thus capable of interfering with deactivation of the EAS marker, which may be an Ultra*Strip III EAS marker, available from Sensormatic Electronics Corporation and deactivatable by a magnetic field to which it is exposed at article checkout. In accordance with the invention, housing 10 is of a dimension, i.e., height, such that EAS marker 34 is spaced from article of manufacture 30 by a distance D (FIG. 7). In the case of usage of the cited Sensormatic EAS marker, such spacing is at least one-quarter of an inch.

Various changes may be introduced in the disclosed preferred embodiment without departing from the invention. Accordingly, it is to be appreciated that the true spirit and scope of the invention is set forth in the following claims.

What is claimed is:

1. An EAS marker assembly for attachment to an article of manufacture, said assembly comprising a housing defining a cavity extending inwardly from an open wall of said housing and a passage extending through a closed wall of said housing opposite said open wall and disposed aside said cavity and an EAS marker secured to said closed wall of said housing, said article of manufacture closing said open wall of said housing when said assembly is attached thereto, said housing being of a dimension between said closed wall of said housing and said open wall of said housing such that said article of manufacture does not interfere with deactivation of said EAS marker.

2. The EAS marker assembly claimed in claim 1, wherein said passage is bounded by interior housing structure extending from said open wall to said closed wall.

3. The EAS marker assembly claimed in claim 2, wherein said interior housing structure is cylindrical in cross-section.

4. The EAS marker assembly claimed in claim 1, wherein said housing closed wall bas first and second portions at respective different spacings from said housing open wall.

5. The EAS marker assembly claimed in claim 4, wherein said EAS marker is secured to an underside of said housing closed wall first portion.

6. The EAS marker assembly claimed in claim 4, wherein said passage extends through said housing closed wall second portion.

7. The EAS marker assembly claimed in claim 6, wherein said passage is bounded by interior housing structure extending from said open wall to said closed wall.

8. The EAS marker assembly claimed in claim 7, wherein said interior housing structure is cylindrical in cross-section.

9. In combination:

(a) an article of manufacture;

(b) an EAS marker assembly comprising a housing defining a cavity extending inwardly from an open wall of said housing and a passage extending through a closed wall of said housing opposite said open wall and disposed aside said cavity and an EAS marker secured to said closed wall of said housing; and (c) a securement member extending through said passage and securing said EAS marker assembly to said article of manufacture, said article of manufacture closing said open wall of said housing, said housing being of a dimension between said closed wall of said housing and said open wall of said housing such that said article of manufacture does not interfere with deactivation of said EAS marker.

10. The invention claimed in claim 9, wherein said passage is bounded by interior housing structure extending from said open wall to said closed wall.

11. The invention claimed in claim 10, wherein said interior housing structure is cylindrical in cross-section.

12. The invention claimed in claim 9, wherein said housing closed wall has first and second portions at respective different spacings from said housing open wall.

13. The invention claimed in claim 12, wherein said EAS marker is secured to an underside of said housing closed wall first portion.

14. The invention claimed in claim 12, wherein said passage extends through said housing closed wall second portion.

15. The invention claimed in claim 14, wherein said passage is bounded by interior housing structure extending from said open wall to said closed wall.

16. The invention claimed in claim 15, wherein said interior housing structure is cylindrical in cross-section.

* * * * *

UNITED STATES PATENT AND TRADEMARK OFFICE

CERTIFICATE OF CORRECTION

PATENT NO. : 7,012,526 B2
APPLICATION NO. : 10/117282
DATED : March 14, 2006
INVENTOR(S) : Kolton, et al.

It is certified that error appears in the above-identified patent and that said Letters Patent is hereby corrected as shown below:

IN THE PATENT:

In Claim 4: now reads "closed wall bas first"
should read --closed wall has first--.

Signed and Sealed this

First Day of August, 2006

JON W. DUDAS
*Director of the United States Patent and Trademark Office*